US008087371B1

(12) United States Patent
Sadegh et al.

(10) Patent No.: US 8,087,371 B1
(45) Date of Patent: Jan. 3, 2012

(54) DEPLOYABLE AND INFLATABLE FENDERING APPARATUS AND METHOD

(75) Inventors: Ali M. Sadegh, Franklin Lakes, NJ (US); Paul V. Cavallaro, Raynham, MA (US); Claudia J. Quigley, Lexington, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 231 days.

(21) Appl. No.: 12/587,330

(22) Filed: Sep. 25, 2009

(51) Int. Cl.
*B63B 59/02* (2006.01)

(52) U.S. Cl. ..... 114/220; 114/119

(58) Field of Classification Search ..... 114/119, 114/120, 219, 220
See application file for complete search history.

(56) References Cited

U.S. PATENT DOCUMENTS

| | | | | | |
|---|---|---|---|---|---|
| 2,417,849 | A | * | 3/1947 | Walters et al. | 114/220 |
| 2,541,928 | A | * | 2/1951 | Loomis | 305/34 |
| 2,753,829 | A | * | 7/1956 | Agra | 114/219 |
| 2,903,990 | A | * | 9/1959 | Brown | 114/219 |
| 2,960,055 | A | * | 11/1960 | Tomek | 114/219 |
| 3,005,435 | A | * | 10/1961 | Roach | 114/220 |
| 3,063,400 | A | * | 11/1962 | Yamaguchi et al. | 114/219 |
| 3,113,546 | A | * | 12/1963 | Mountcastle | 114/219 |
| 3,140,111 | A | * | 7/1964 | Dabroski | 362/505 |
| 3,286,680 | A | * | 11/1966 | Caretta | 114/219 |
| 3,528,383 | A | * | 9/1970 | Fetters | 114/220 |
| 3,593,531 | A | * | 7/1971 | Saadeh et al. | 405/212 |
| 3,765,366 | A | * | 10/1973 | Connelly | 114/219 |
| 3,864,922 | A | * | 2/1975 | Dial et al. | 405/215 |
| 3,964,422 | A | * | 6/1976 | Boyd | 114/219 |
| 3,988,997 | A | * | 11/1976 | Fenton | 114/219 |
| 4,043,545 | A | * | 8/1977 | Dial et al. | 267/116 |
| 4,054,476 | A | * | 10/1977 | Hara et al. | 156/191 |
| 4,063,526 | A | * | 12/1977 | Ueda | 114/220 |
| 4,136,632 | A | * | 1/1979 | Day et al. | 114/220 |
| 4,351,257 | A | * | 9/1982 | Brown, Jr. | 114/219 |
| 4,357,891 | A | * | 11/1982 | Sluys | 114/230.27 |
| 4,408,556 | A | * | 10/1983 | van der Wiel | 114/219 |
| 4,478,536 | A | * | 10/1984 | Drewett et al. | 405/213 |
| 4,815,777 | A | * | 3/1989 | Campbell | 293/107 |
| 4,841,893 | A | * | 6/1989 | Ellison | 114/219 |
| 4,875,427 | A | * | 10/1989 | Harris, Jr. | 114/219 |
| D308,192 | S | * | 5/1990 | Ellison | D12/168 |
| 4,924,796 | A | * | 5/1990 | Duffy | 114/219 |
| 4,970,980 | A | * | 11/1990 | Eisner | 114/219 |

(Continued)

FOREIGN PATENT DOCUMENTS

EP 292335 A1 * 11/1988

(Continued)

*Primary Examiner* — Lars A Olson
*Assistant Examiner* — Andrew Polay
(74) *Attorney, Agent, or Firm* — James M. Kasischke; Michael P. Stanley; Jean-Paul A. Nasser

(57) ABSTRACT

A deployable and inflatable/deflatable fendering apparatus capable of providing protection for watercrafts and docks. The apparatus has an inflatable cylindrical body, an outer collar body, and a water reservoir with an inflating and deflating means. The collar body circumferentially surrounds the cylindrical body, and is made of abrasion resistant materials and protects the cylindrical body from punctures, tearing and abuse. The collar body may be inflatable or filled with foam-like material. The reservoir comprises a one-way valve, a series of ballasts and is attached to the cylindrical body and is expandable to provide stabilization of the fendering apparatus. The fendering apparatus can be deflated for storage.

20 Claims, 10 Drawing Sheets

U.S. PATENT DOCUMENTS

| | | | | | |
|---|---|---|---|---|---|
| 5,016,554 | A * | 5/1991 | Harris et al. | 114/219 |
| 5,048,446 | A * | 9/1991 | Powell | 114/219 |
| 5,215,031 | A * | 6/1993 | Inman et al. | 114/360 |
| 5,357,888 | A * | 10/1994 | Insinna | 114/69 |
| 5,685,752 | A * | 11/1997 | Fulton, Jr. | 441/90 |
| 6,112,691 | A * | 9/2000 | Bajeli et al. | 114/230.1 |
| 6,161,494 | A * | 12/2000 | Pontevolpe et al. | 114/219 |
| 6,196,150 | B1 * | 3/2001 | Fondacaro | 114/219 |
| 6,283,677 | B1 * | 9/2001 | Slattery et al. | 405/215 |
| D452,466 | S * | 12/2001 | Skulnick | D12/168 |
| 6,332,421 | B1 * | 12/2001 | Leonard et al. | 114/220 |
| 6,357,377 | B1 * | 3/2002 | Santelli, Jr. | 114/219 |
| 6,540,442 | B1 * | 4/2003 | Slattery et al. | 405/212 |
| 6,637,360 | B2 * | 10/2003 | Vretta | 114/219 |
| 7,107,922 | B2 * | 9/2006 | Hattori | 114/219 |
| 7,107,923 | B2 * | 9/2006 | Chauncey et al. | 114/220 |
| 7,150,241 | B1 * | 12/2006 | Boutaghou | 114/219 |
| 7,287,483 | B2 * | 10/2007 | Thompson | 114/219 |
| 7,322,307 | B1 * | 1/2008 | Perry | 114/219 |
| D576,087 | S * | 9/2008 | Schlinkert | D12/168 |
| 7,421,965 | B2 * | 9/2008 | Wakabayashi et al. | 114/219 |
| 7,421,966 | B2 * | 9/2008 | Boutaghou | 114/219 |
| 7,448,338 | B2 * | 11/2008 | Stewart et al. | 114/219 |
| 7,617,792 | B1 * | 11/2009 | Pursley | 114/219 |
| 7,650,845 | B2 * | 1/2010 | Vanoise et al. | 114/68 |
| 2002/0050241 | A1 * | 5/2002 | Leonard et al. | 114/220 |
| 2004/0011267 | A1 * | 1/2004 | Kent | 114/220 |
| 2004/0020417 | A1 * | 2/2004 | Krentz | 114/220 |
| 2007/0175376 | A1 * | 8/2007 | Vanoise et al. | 114/219 |
| 2008/0006195 | A1 * | 1/2008 | Abel | 114/219 |
| 2008/0083364 | A1 * | 4/2008 | Taylor | 114/360 |
| 2009/0107384 | A1 * | 4/2009 | Stephenson, Jr. | 114/219 |

FOREIGN PATENT DOCUMENTS

| | | | |
|---|---|---|---|
| JP | 59124838 | A * | 7/1984 |
| JP | 62033916 | A * | 2/1987 |

* cited by examiner

DEPLOYABLE AND INFLATABLE FENDERING APPARATUS AND METHOD

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER PATENT APPLICATIONS

None.

BACKGROUND OF THE INVENTION

1. Field of the Invention

The present invention generally relates to fendering devices and, more particularly, to an inflatable fendering apparatus capable of stable operation while absorbing kinetic energy in order to prevent damage to watercraft and marine structures.

2. Description of the Prior Art

Fendering systems are used to absorb the kinetic energy of watercraft during berthing operations and to provide a safe minimum standoff distance between moored vessels and other marine structures such as docks, piers, and the like. The principal function of fendering systems is to prevent damage caused by direct contact of the watercraft's hull to other watercraft, docks, piers, and the like. In particular, berthing forces can result in impact and abrasion damage to a watercraft's hull or other marine structures.

Many types of watercraft fender designs (including inflatable and resilient systems) are known to those skilled in the art. The problem with these types of fenders is that the fenders do not provide a reasonable standoff distance for large watercrafts and the fenders do not absorb a significant magnitude of berthing kinetic energy. In addition, during a rough sea state, these fenders are not stable and may swing significantly so that their function could be compromised. Furthermore, these fenders require a large space for stowing and storage since many cannot be deflated after use.

The following patent references describe various prior art systems that may be related to the above and/or other bumper and fender devices:

U.S. Pat. No. 6,161,494 teaches an inflatable apparatus that is located on the hull of a boat, and means for inflation and deflation of the inflatable member. The disadvantage of this apparatus is that the height of the apparatus is not adjustable to the water level and may not be effective if the water level is different than that of the fender's location on the hull. In addition, this apparatus is not suited for retrofitting to other boats because the apparatus requires structural changes to the boat.

U.S. Pat. No. 5,357,888 teaches an inflatable apparatus that is attached to the hull of a boat in a longitudinal direction. Similar to the previous cited reference, the disadvantage of this apparatus is that the apparatus is fixed in location and does not float with the water level. Also, the apparatus requires modification of the hull structure.

U.S. Pat. No. 4,815,777 teaches a trim guard assembly apparatus with a flexible member and a hollow closure which may be filled with a fluid or emptied. The trim guard assembly apparatus is used in combination with a vehicle body having an outer protective member, an inner base member, and a flexible, intermediate substantially hollow closure provided therebetween. The hollow closure may be selectively filled with or emptied of a fluid, thereby respectively expanding or retracting the protective member. In use, when in a parked position, the protective member is expanded thereby absorbing minor impacts such as outswung doors, protected shopping carts and the like. When the vehicle is in motion, the protective member is retracted; thereby, re-achieving aerodynamic streamlining of the automotive vehicle. The disadvantage of this apparatus is that the standoff distance is limited and requires structural modification of the hull.

U.S. Pat. No. 4,970,980 teaches a side protector similar to the previously cited reference which may be affixed to the hull of a watercraft having an inflatable bladder. The protectors are modularized and a plurality of the protectors may be affixed to the craft along either horizontal rows or individual protectors may be vertically orientated, depending on the anticipated need for protection. A snap-lock type connection, including mating extensions and recesses in a chamber closed at one end, is provided for affixing the bladder edges to the base holder. A space is left between the legs of bladder connector so that when high pressure air is added to cause inflation of the bladder, the same air also creates additional pressure maintaining the bladder coupled to the base. An air compressor and operator's panel are provided which permits any of the various bladders to be inflated depending on the particular need at the particular time. In addition, the bladder contains a setoff in the interior thereof to maintain the bladder spaced apart from the holder mechanism to prevent flapping, as well as to provide additional strength at the point of contact of the inflated bladder with the hard object against which protection is desired. A disadvantage of this device is that it is fixed to the hull and is therefore independent of the water level.

U.S. Pat. No. 4,841,893 teaches a cylindrical fender with rings to prevent the fender from popping up between the side of a watercraft and corresponding dock or other structure to which the craft is tied off. The circumferential rings prevent the fender from popping up from between the side of a boat and a corresponding dock or other structure to which the boat is tied off, with the circumferential rings providing for a rolling and tracking motion of the fender over the side of the boat to limit fender swing which maintains the fender in place and in a generally vertical orientation. This tracking prevents the non-tethered end of the fender from popping up. The disadvantages of this fender are that it does not teach the deflation or storage of the fender and is applicable only for small watercraft.

U.S. Pat. No. 5,215,031 also teaches a protective device for a watercraft with rigid hull that is inflatable and structurally fixed to the hull. The device consists of a first inflatable bumper mounted to the rigid hull about the gunwale, which will absorb impacts to the hull when the boat is pulled next to a dock or the like. A second inflatable bumper is mounted to the rigid hull at the waterline to keep the rigid hull afloat if it becomes cracked. A mechanism is in the cockpit for selectively inflating the first inflatable bumper and the second inflatable bumper. The same above-mentioned disadvantages apply to this patent.

The above-cited prior art does not disclose fendering devices which provide reasonable standoff distances between watercraft and/or the capability to safely absorb the kinetic energies associated with berthing watercraft and larger ships. Therefore, there is a continuing need for a reliable fendering system for watercraft and large ships in which the fendering system is inflatable; deflatable; rapidly deployable; able to absorb significant kinetic energies; dynamically stable in rough sea states; designed for minimal stowage volume and used to provide minimum standoff distance between watercraft and other marine structures.

SUMMARY OF THE INVENTION

It is therefore a general purpose and primary object of the present invention to provide an improved fendering apparatus.

It is a further object of the present invention to provide a fendering apparatus capable of significant impact absorption of the berthing kinetic energies of watercraft and larger ships.

It is a still further object of the present invention to provide a minimum standoff distance between watercraft and other marine structures.

It is a still further object of the present invention to provide a fendering apparatus that is dynamically stable in high sea states; can follow the free surface of a watercraft in a general vertical direction; and prevents "pop-out" from in-between watercraft and other marine structures.

It is a still further object of the present invention to provide a protective means around a fendering apparatus that is rotatable; free to move axially with respect to the main body; absorbs impact; and is resilient to abrasion and friction between the watercraft and other marine structures.

It is a still further object of the present invention to provide a fendering apparatus that is deflatable, compactable and can be stowed onboard a watercraft using minimum space.

In order to attain the objects described, the present invention comprises a deployable and inflatable/deflatable, fendering apparatus as a protector for watercraft, docks, piers and other marine structures. The fendering apparatus includes an inflatable cylindrical body, an outer inflatable collar body, a one-way passive valve, a water (or alternate fluid) reservoir and an inflation/deflation means. The inflatable cylindrical body may include an outer wall (made of woven fabric) a bladder, upper and lower joints, a cable connecting the upper and lower joints, a system of valves and an air pressure supply line.

The inflatable collar body circumferentially surrounds the cylindrical body and is made of abrasion resistant materials. The collar body is loosely connected to a ring located on the crown of the cylindrical body through set of loosened ropes for safety and constraint of the collar. The water reservoir (attachable to the cylindrical body) may comprise a one-way valve and a series of ballasts.

The inflating/deflating means may comprise a pneumatic pressurizing system. Upon inflating the cylindrical body, the tendering apparatus is erected, deployed, and then vertically placed on the sides (hull) of a watercraft or other marine structure. As the fendering apparatus enters the water, the ballast (dead weights) at the bottom of the reservoir pulls down and stretches the reservoir such that the one-way valve passively opens. Water (or alternate fluid) then enters into the reservoir and fills the volume. The air in the reservoir is then forced out through a vent.

As surface waves contact the fender apparatus, the inflatable collar body freely moves axially and rotatably with respect to the cylindrical body which in turn maintains the fender in a proper position and in a generally vertical orientation.

The collar also provides a standoff distance between the watercraft and other marine structures and is always floating. This feature ensures that the collar body is between the watercraft and adjacent marine structure to absorb the impact.

To retrieve and stow the fender apparatus, as the device is pulled from the water, a rope connected to the one-way valve is pulled to open the valve and allow water to drain from the reservoir. Once on deck, the cylindrical body and the collar are deflated. The fender apparatus is then stowed in a compact format onboard the watercraft or other marine structure.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

DETAILED DESCRIPTION OF THE INVENTION

Figure 1:
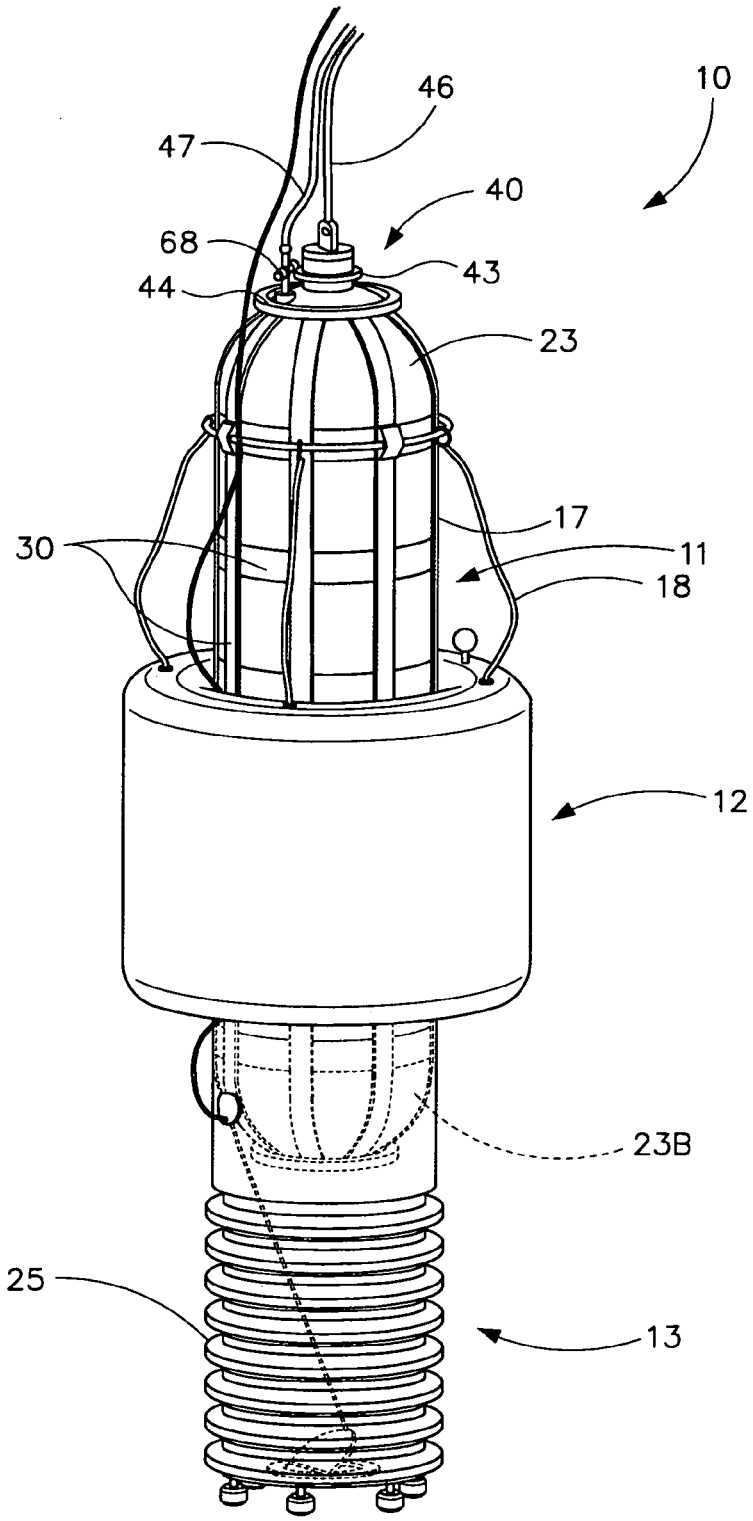
FIG. 1 is a perspective view, partially in dashed lines, of one embodiment of a deployable and inflatable fendering apparatus of the present invention.
Figure 2:
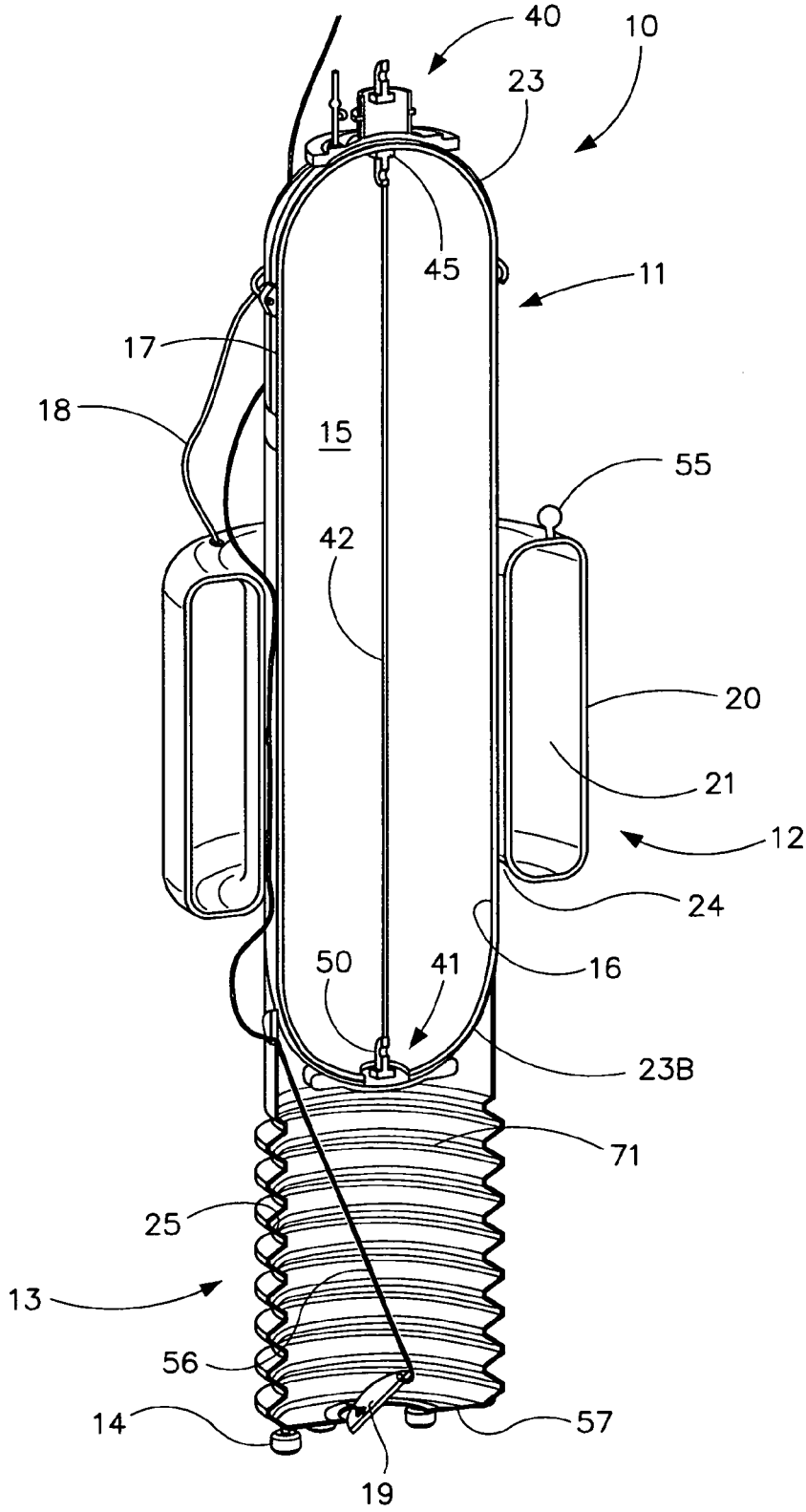
FIG. 2 is a perspective view, in cross-section, of FIG. 1 in accordance with the present invention.

Referring to FIG. 1 and FIG. 2, one embodiment of the deployable and inflatable/deflatable hybrid fendering apparatus 10 has a cylindrical body 11, a collar body 12 (that circumferentially surrounds the cylindrical body) and a water reservoir 13. The cylindrical body 11 may include a cylindrical wall (skin) 17 and two end caps 23, 23B. The end caps 23, 23B can be hemispherical or oval shaped. In one embodiment, the skin 17 and the end caps 23, 23B may be made of flexible non-metallic materials—such as woven fabric.

A grid system of webbing straps 30, surrounds the cylindrical body 11, and runs longitudinally and circumferentially with respect to the cylindrical body. The webbing straps 30 protect the fabric material (wall or skin) 17 of the cylindrical body 11 from unexpected (longitudinally and circumferentially) excessive expansions.

As shown in FIG. 2, the skin 17 contains a bladder 16, which may be made of elastomer and/or other highly compliant material. The bladder 16 seals an internal volume 15, which contains pressurized air during operation. For additional support, a cable 42 within the volume 15 may be utilized to connect an upper joint 40 and a lower joint 41. A bracket 45 on the interior surface of the upper joint 40 may include a connecting eye-shaped hook where the cable 42 is securely fastened. The lower joint 41 may include a cap 50 with an eye-shaped hook where the end of the cable 42 is securely connected.

Figure 5:
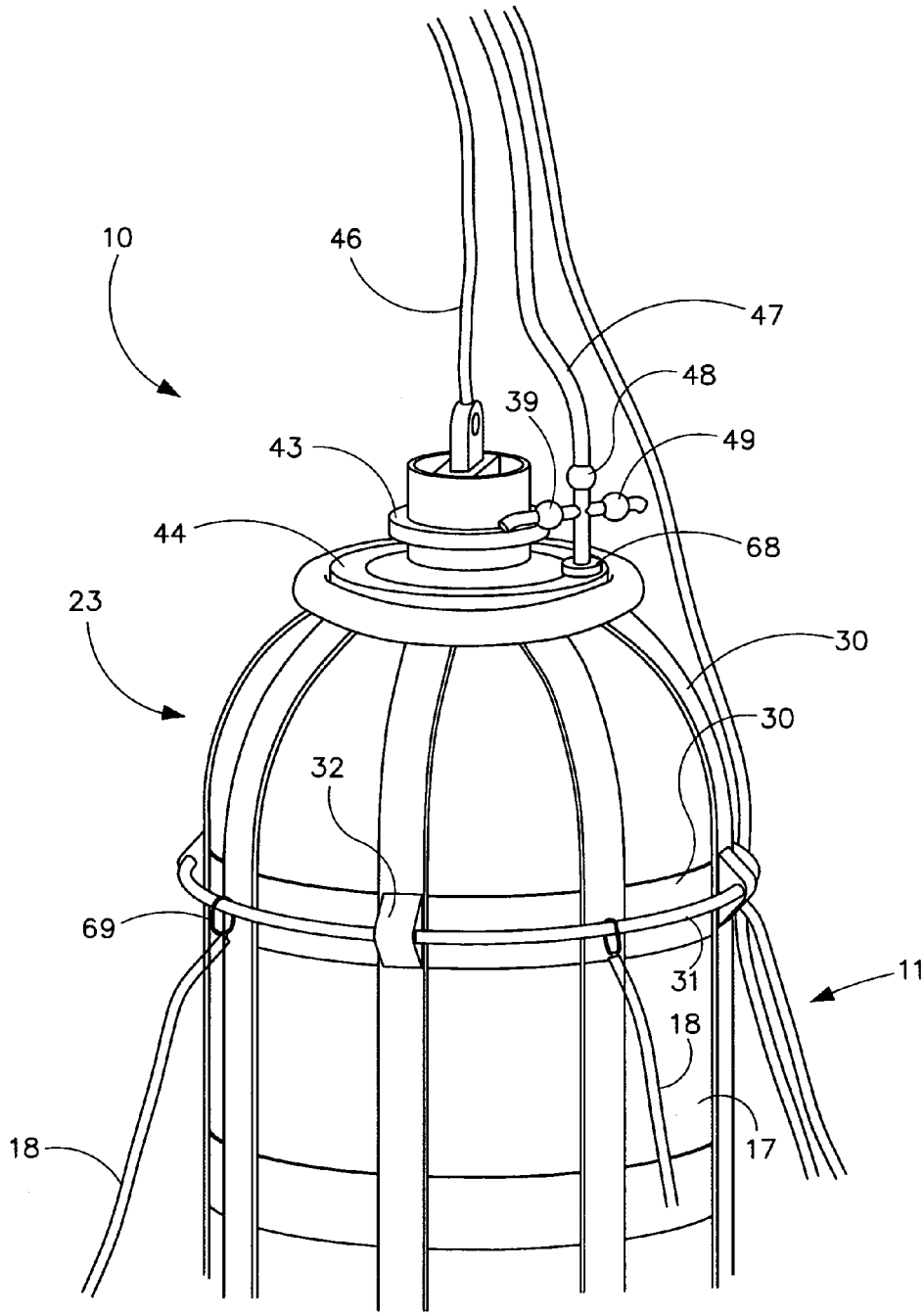
FIG. 5 is a perspective view of an upper joint assembly of FIG. 1 showing the valves and connections in accordance with the present invention.

Referring now to the details of FIG. 5, the upper joint 40 may include a swivel 43 to which a suspension cable 46 is securely attached. A cap 44 may include multiple air ports (including an air pressure port 68) which connect to an air pressure supply line 47. Also utilized are two one-way shutoff valves 48 and 39 and a pressure release valve 49.

A ring 31 loosely connects to the top circumferential strap of the webbing 30 through four holding straps 32. Ropes 18 loosely connect the collar body 12 to the ring 31 through rings 69 so that a sliding movement of the collar body with respect to the cylindrical body 11 is limited.

Referring again to FIG. 1 and FIG. 2, the collar body 12 includes an outer wall 20 in which the outer wall is made of elastomer or rubber-like material that seals an internal volume 21. The collar body 12 is tubular with an interior diameter that is somewhat larger than an outer diameter of the cylindrical body 11. A one-way valve 55 is located on the exterior surface of the collar body 12 and may be used for filling the internal volume 21 with air. Alternatively, the internal volume 21 may be filled with foam-like materials.

The air pressure or the foam-like materials dampen the impact event of the watercraft and/or other marine structures. In one example, the collar body 12 may have a different internal pressure than the cylindrical body 11. Having varying internal pressures allows the fendering apparatus 10 to be configured for varying operating circumstances or sea states. Deflection curves or other sizing criteria may be used to determine the configuration and internal pressures of the fendering apparatus.

Due to the fact that the collar body 12 is made of elastomer and is filled with air or foam, the density of the collar body is less than water density (or the density of a comparable fluid) and thus, the collar body is positively buoyant. During operation, the level of water 22 (See FIG. 9) typically may be about halfway of the height of the collar body 12. With wave motions and because of space clearance 24 between the cylindrical body 11 and the collar body 12 (See FIG. 2), the collar body moves relatively freely along the longitudinal direction of the cylindrical body. The collar body 12 can also rotate with respect to the cylindrical body 11. The length of the ropes 18 limits the downward movement of the collar body 12 below the reservoir 13. The collar body 12 does not pass end cap 23 of the cylindrical body 11 since the cylindrical body is an air-filled body capable of floating.

Figure 4:
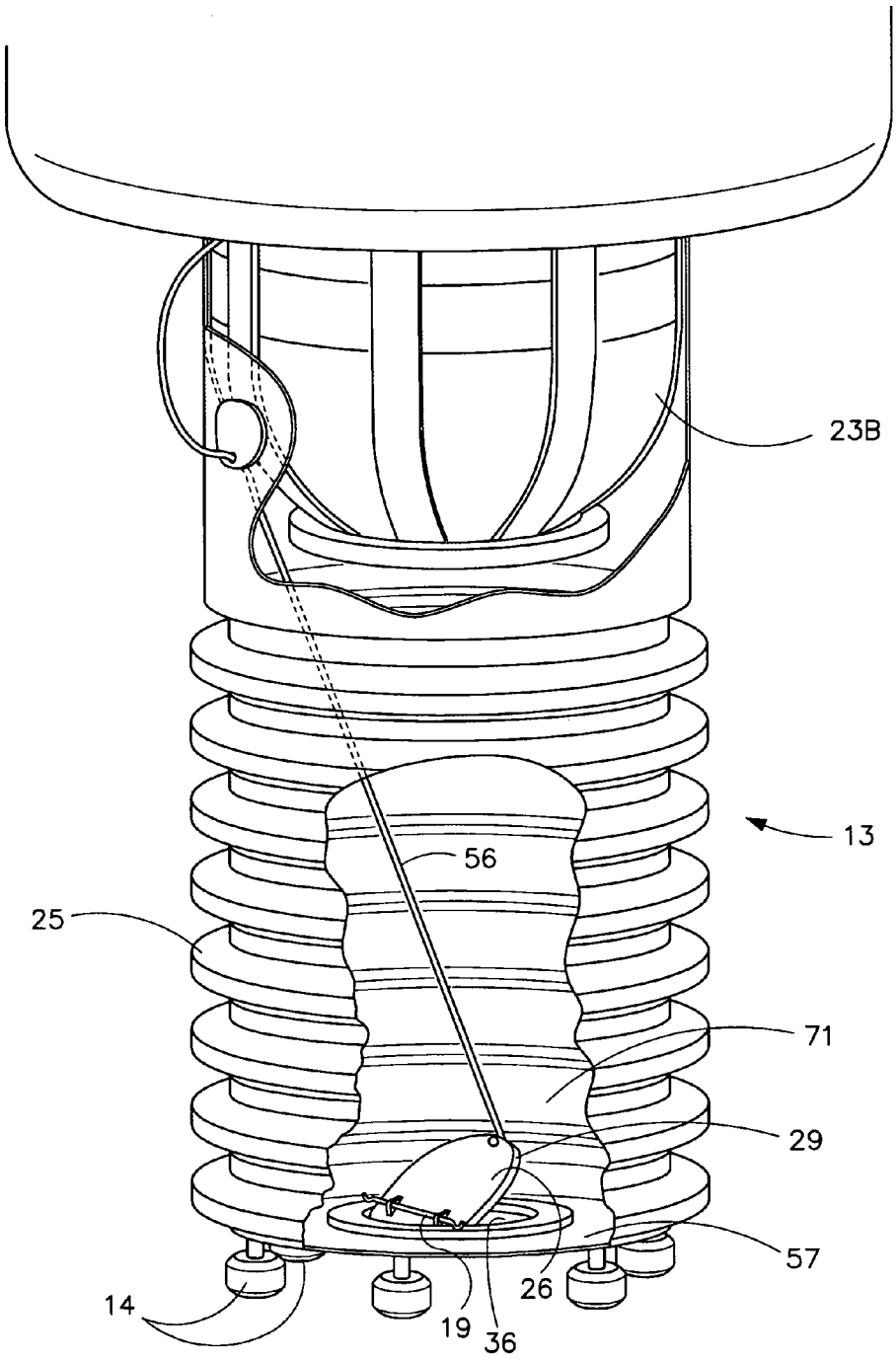
FIG. 4 is a perspective view, partially cut away, of the water reservoir of FIG. 1 in accordance with the present invention.

Referring again to FIG. 2 and FIG. 4, the reservoir 13 may include a flexible and expandable/contractible outer wall (skin) 25 that may be of accordion-like shape. A rigid base plate 57 is attached to bottom of the outer wall 25. A passive one-way valve 26 is positioned at the center of the base plate 57 and is attached to a release rope 56. The one-way valve 26 has a hinge 19 that is eccentrically located on one side of the valve. A lip 29 is weighted to add a bias force on one side of the valve 26, which naturally tends to close aperture (opening) 36 of the valve. The lip 29 also stops the rotation of the valve 26 beyond the plane of the plate 57. The release rope 56 is rigidly attached to the upper surface of the valve 26 and extends upwardly going through the space 24 between the cylindrical body 11 and the collar body 12. The release rope 56 extends to the upper joint 40 and goes to the surface with the suspension cable 46.

A set of ballast or dead weights 14 is attached to the rigid plate 57. As the reservoir 13 is immersed in the water, the ballasts 14 extend and elongate the reservoir wall 25. Because of the water pressure on the bottom surface of the one-way valve 26, the valve opens and the water enters into the reservoir cavity 71 with little or no resistance. Once fully submerged, the accordion-like wall (skin) 25 is fully-extended and enlarged; thereby, allowing the water to completely or substantially completely fill the reservoir cavity 71. The one-way valve 26 is biased to close, thereby containing water within the water reservoir 13.

Figure 3:
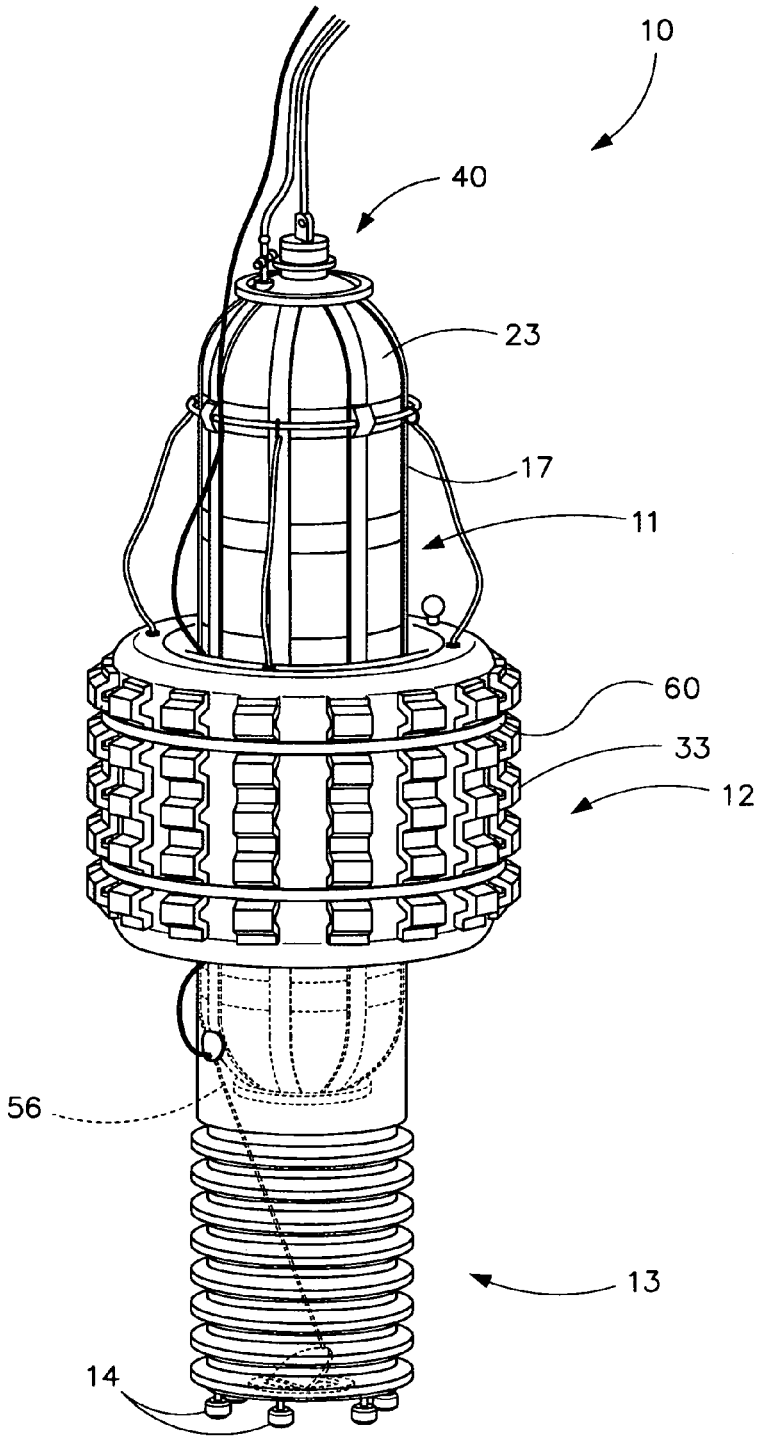
FIG. 3 is a perspective view, partially in dashed lines, of an inflatable fendering apparatus with a collar body comprising exterior abrasion members in accordance with one possible embodiment of the present invention.
Figure 6:
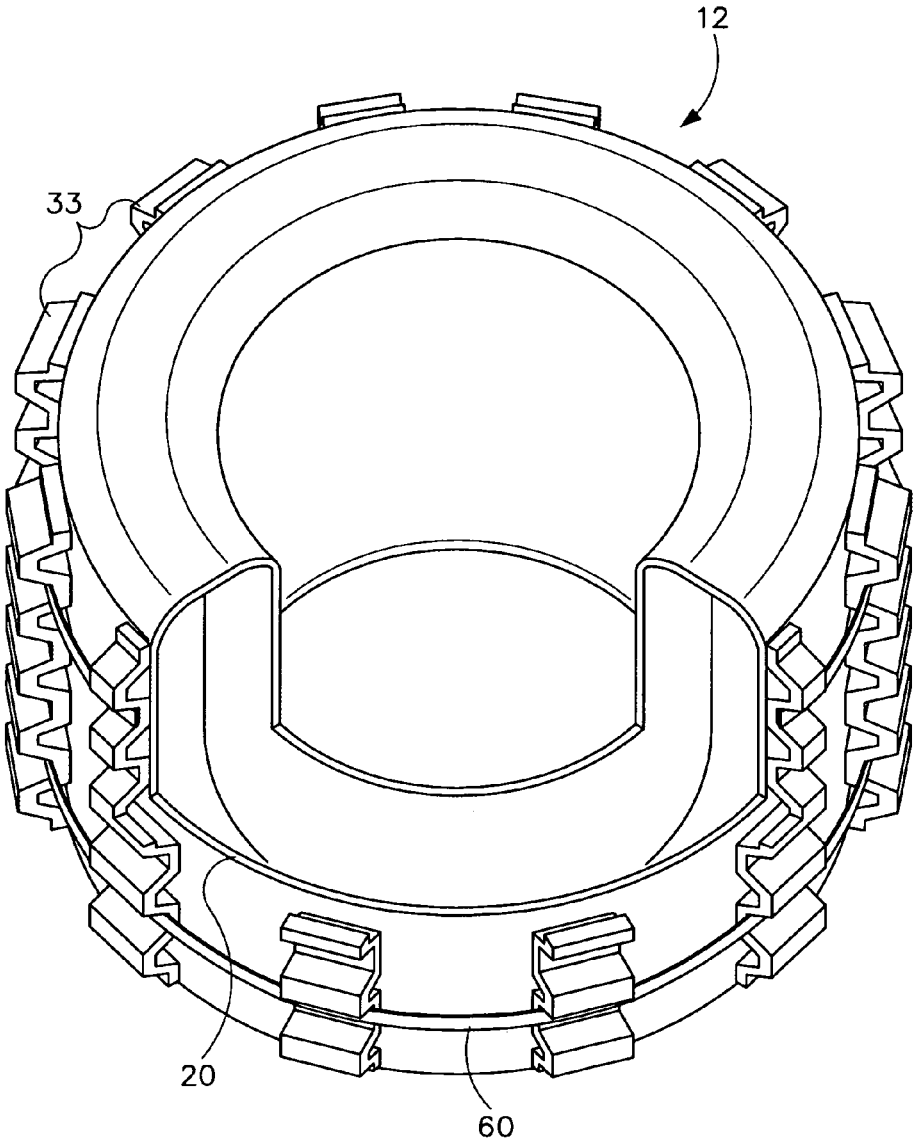
FIG. 6 is an enlarged perspective view, partially cut away, of another embodiment of the outer surface of a collar body in accordance with one possible embodiment of the present invention.
Figure 7:
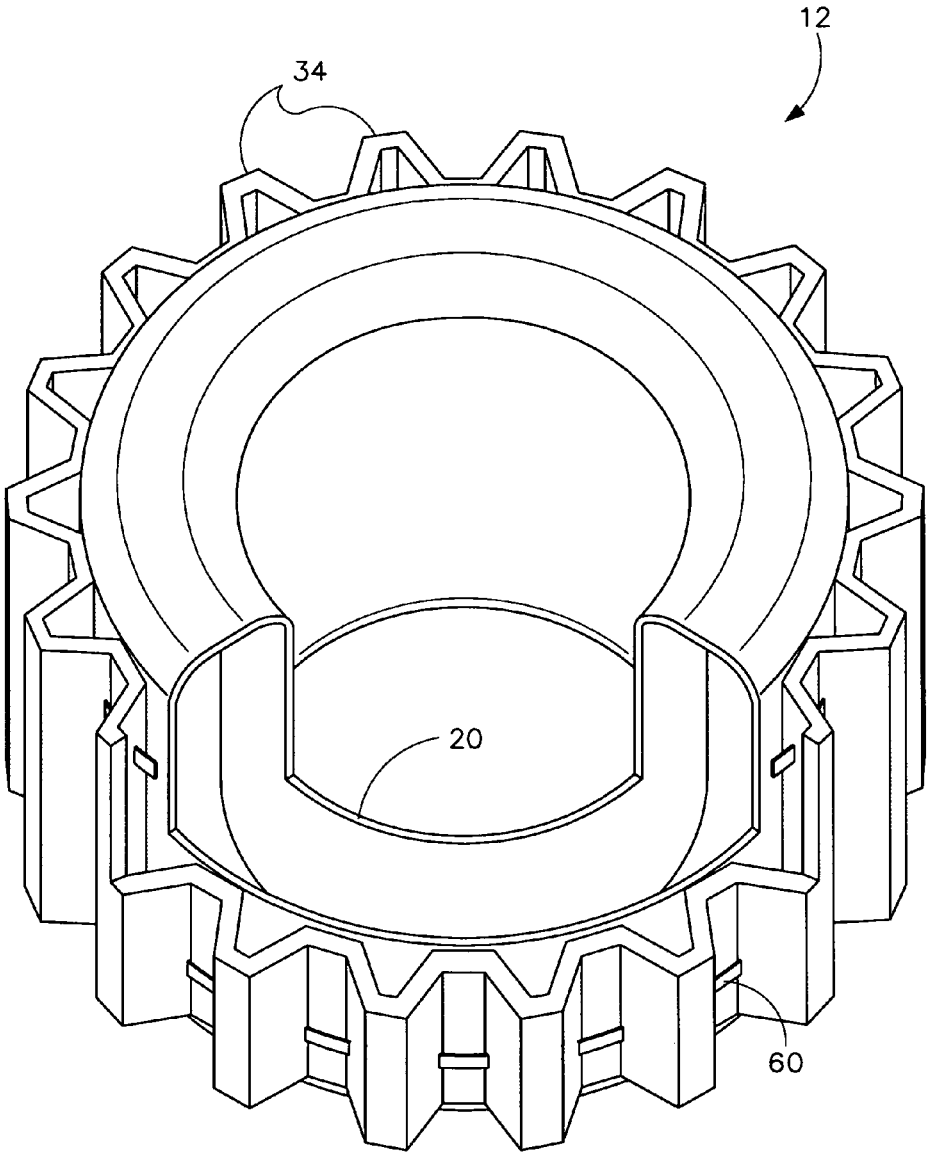
FIG. 7 is an enlarged perspective view, partially cut away, of another embodiment of the outer surface of a collar body in accordance with the present invention.

Referring to FIG. 3, FIG. 6, and FIG. 7, in another embodiment of the collar body 12, an impact protection and abrasion surface (means) 33 or 34 may be added to the outer surface of collar body. Straps 60 may be used circumferentially to secure the abrasion surfaces 33 or 34 to the collar body 12. The cross-section of the abrasion surfaces 33 or 34 is depicted as a trapezoidal cross-section; however, other cross-sections may be utilized.

If needed, the abrasion surfaces 33 or 34 also create more standoff distance between the watercraft and other marine structures. The abrasion surfaces 33 or 34 may be constructed of corrugated elastomer-like materials that are circumferentially located around the outer surface of the collar body 12.

Figure 8:
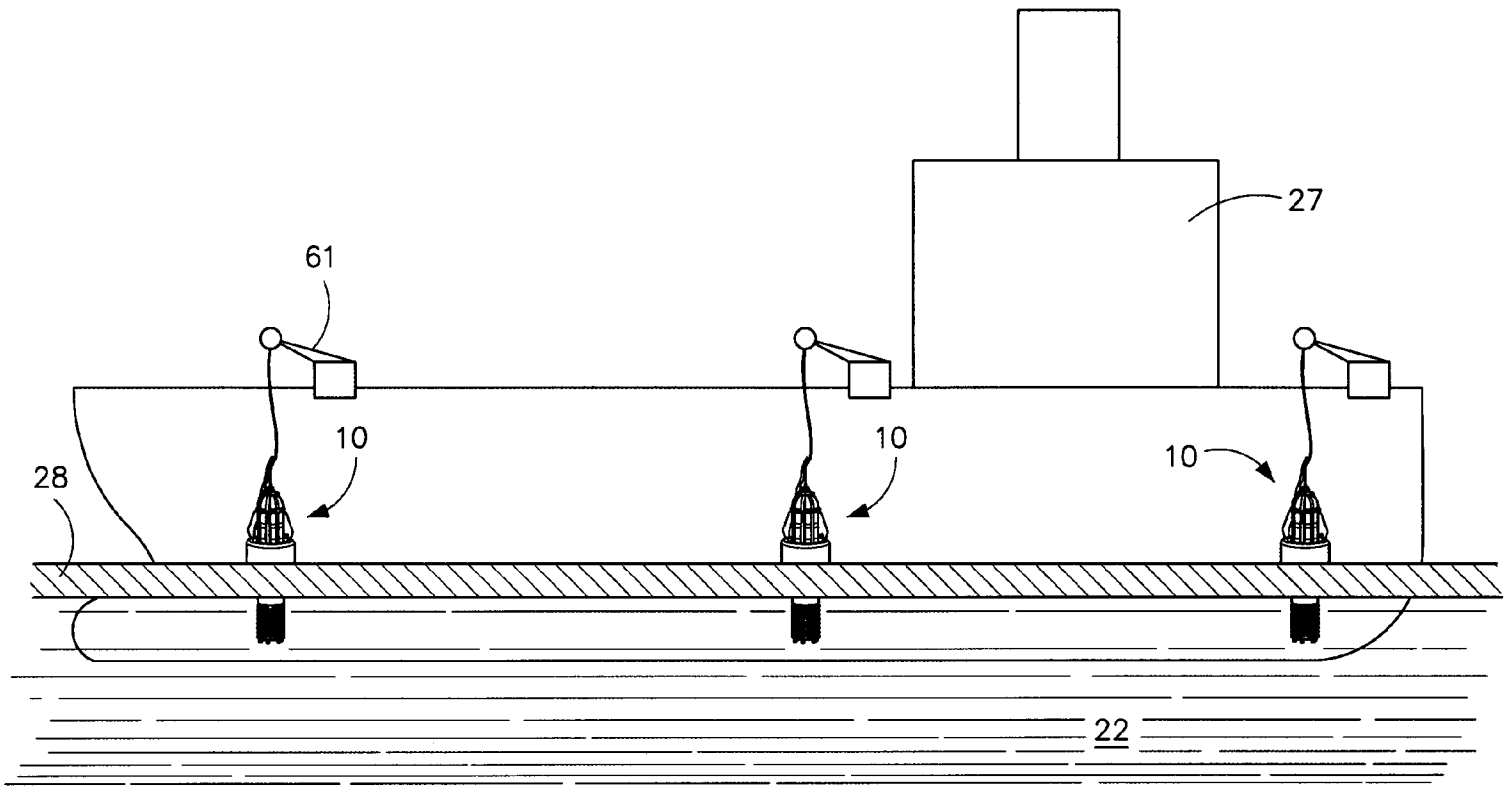
FIG. 8 is an elevational view, partially in cross-section, of three deployable and inflatable/deflatable fendering devices that may be used for large watercraft in accordance with the present invention.

Referring to FIG. 8, the fendering apparatus 10 is used for protection of a watercraft 27 from an adjacent structure 28 such as a dock, other watercraft and marine structures. For deployment and retrieval of the fendering apparatus 10 from large watercraft, a handling system 61 may be employed. For smaller watercraft, the fendering apparatus 10 could be fabricated in smaller scale and the crane system may not be needed. The fendering apparatus 10 could also be deployed manually through a conventional anchoring or cleat system such as anchoring or cleat system 62 (See FIG. 9).

The fendering apparatus 10 is initially stowed in a compacted shape. Specifically, both the reservoir 13 and the cylindrical body 11 are collapsed and compacted within the interior surface of the collar body 12. When the collar body 12 is filled with pressurized air as per one embodiment of the invention, the pressure in the collar body could be released; thereby, allowing even further reduction of the stowed volume of the fendering apparatus 10.

Returning to FIG. 5, the deployment process of the fendering apparatus 10 is as follows. Upon opening the shut off valve 48; closing the valve 39; and adjusting the valve 49 for specific pressure release; the pressurized air is supplied through the line 47 into the volume (cavity) 15 of the cylindrical body 11, which starts to inflate and rise out from within the collar body 12.

Once the cylindrical body 11 is fully pressurized, the handling system 61 pulls the fendering apparatus 10 upwardly by utilizing the suspension cable 46. As the handling system 61 lifts the fendering apparatus 10, the collar body 12 slides along the cylindrical body 11 until being suspended by the ropes 18 and the hook rings 69. At the same time, the ballasts (dead weight) 14 expand the water reservoir 13 downwardly. The handling system 61 then turns and extends the fender apparatus 10 outward from the watercraft and lowers the fender apparatus in the water.

Figure 9:
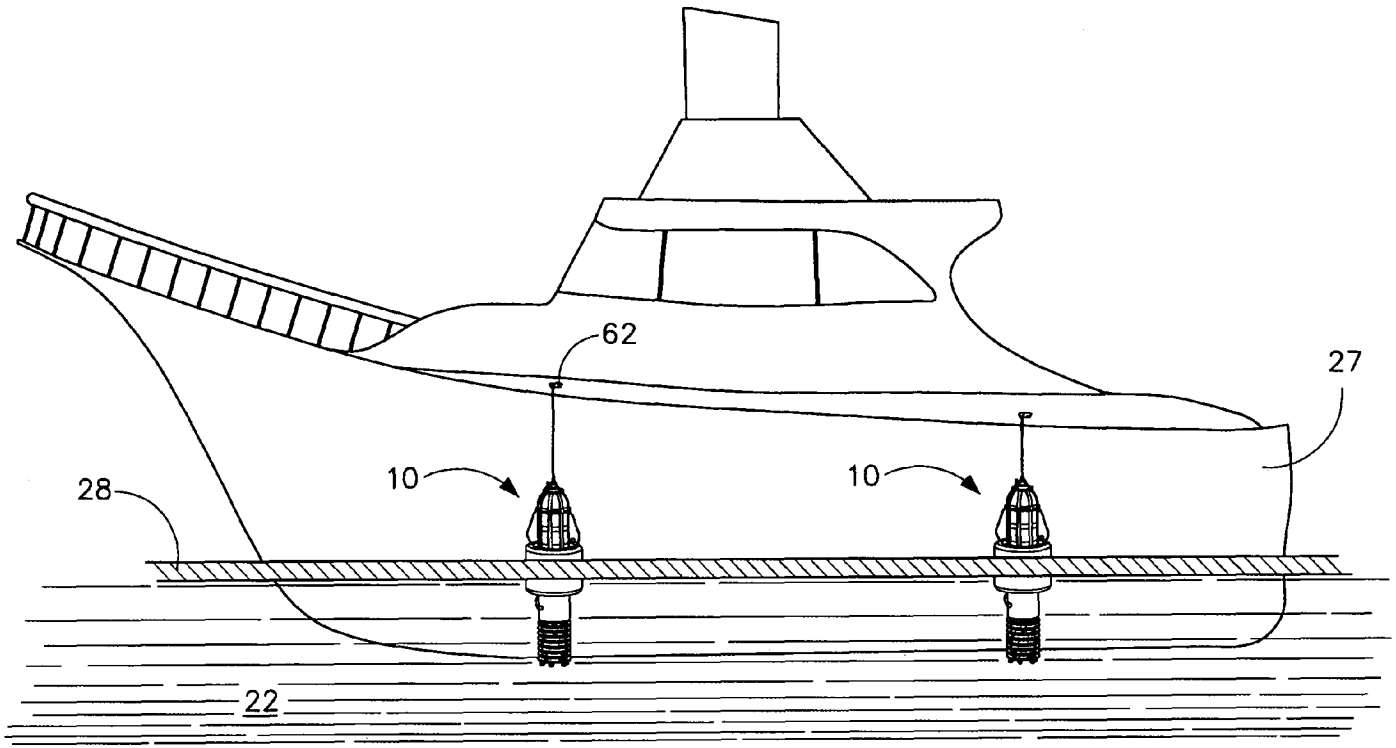
FIG. 9 is an elevational view, partially in cross-section, of two deployable and an inflatable/deflatable fendering devices used for large watercraft in accordance with the present invention.

As the base plate 57 reaches the water, the one-way valve 26 opens to allow water into the reservoir 13. As the handling system 61 lowers the fendering apparatus 10 further, water enters and fills the reservoir 13. When fully expanded, the outer wall (skin) 25 of the reservoir 13 is stretched and water occupies the reservoir. The mass of water contained in the reservoir 13 stabilizes the fendering apparatus 10 from lateral surge or sway motions. As free surface waves move over the fendering apparatus 10, the collar body 12 freely moves linearly and rotatably with respect to the cylindrical body 11; thereby, maintaining the fendering apparatus 10 in proper position and in a general vertical orientation:

In the process of berthing the watercraft 27, as shown in FIG. 8 and FIG. 9, the outer surface of the collar body 12 which is floating on the free surface, comes in contact with the adjacent structure 28, which could be a dock, another watercraft or other marine structure.

The watercraft 27 basically has three translational motions; sway (in the x-direction), surge (in the y-direction) and heave (in the z-direction) and three rotational motions; pitch (rotation about the x-axis), roll (rotation about the y-axis) and yaw (rotation about the z-axis) with respect to the adjacent structure 28. Note that the x-direction is along the longitudinal direction of the boat, the y-direction is the lateral direction of the boat and the z-direction is the vertical direction of the watercraft.

In all motions, the collar body 12 absorbs the primary impact. Specifically, in sway, roll and yaw motions the dominant force in the collar body 12 is compression. However, in surge, heave and pitch motions the dominant force is shear. In the compression mode, the collar body 12 is squeezed between the watercraft 27 and the adjacent structure and the interior surface of the collar body comes in contact with the cylindrical body 11. This contact increases the internal pressure of the cylindrical body 11. As the standoff distance between the watercraft 27 and the adjacent structure 28 decreases, or the berthing energy increases, the air pressure inside the cylindrical body 11 increases. If the internal pressure of the cylindrical body 11 reaches the allowable maximum pressure, then pressure release valve 49 opens and releases a differential pressure.

Figure 10:
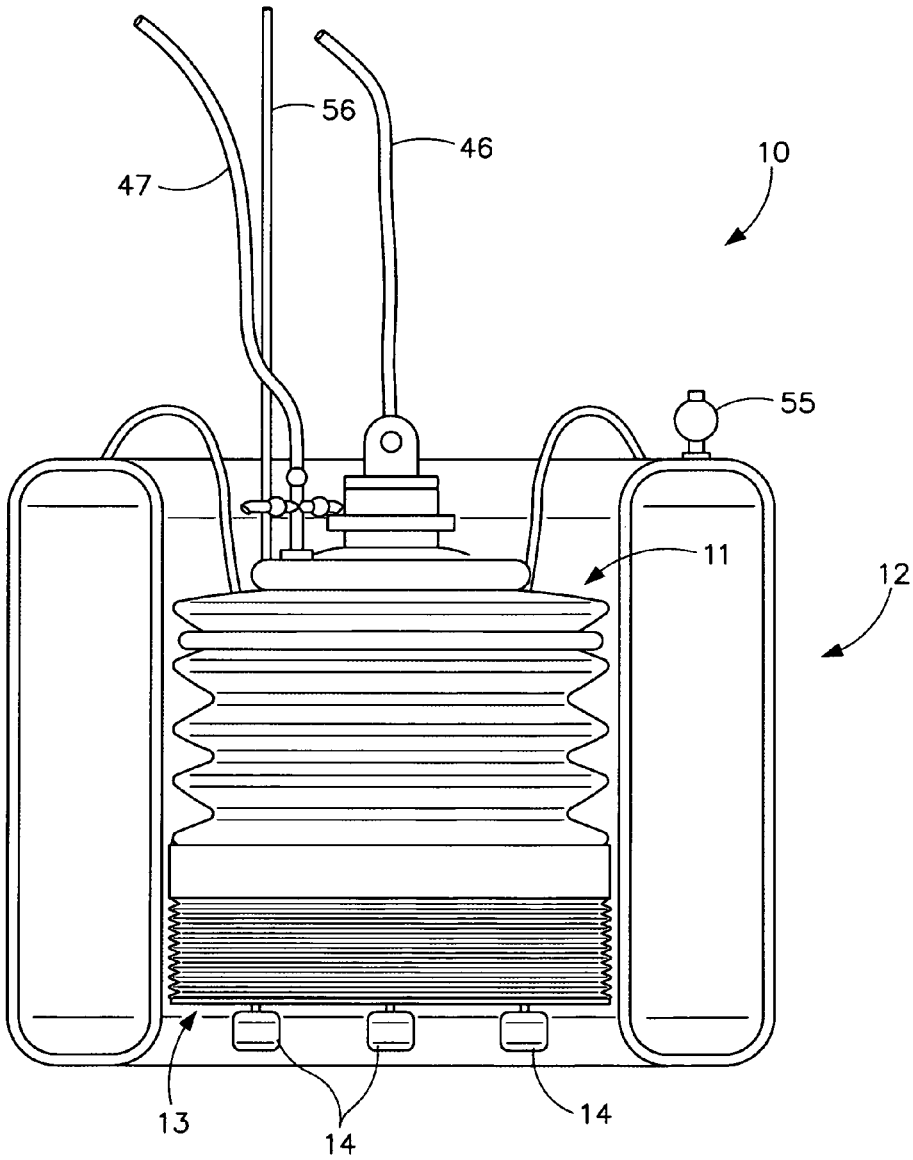
FIG. 10 is an elevational view, partially in cross-section, of an inflatable fendering apparatus of the present invention when stowed.

For retrieval, the fendering apparatus 10 may be lifted out of the water by the handling system 61. The rope 56 is pulled to open the valve 26 in order to allow the water to drain from the reservoir 13. Then the handling system 61 lifts the fendering apparatus 10 from the side of the watercraft 27 to the deck area. The valve 48 may then be closed and the valve 39 opened to release the air pressure inside the cylindrical body 11. The fendering apparatus 10 is then compressed and pushed into the space within the middle of the collar body 12. The fendering apparatus 10 is then stowed in a compact format onboard the watercraft 27 (See FIG. 10)

As mentioned above, the abrasion surfaces (layers) 33 and 34 may be utilized to provide additional standoff distance between the watercraft 27 and adjacent structure 28. If needed, different shapes of the corrugated forms could be used to create larger standoff distances.

Many additional changes in the details, components, steps, and organization of the system, herein described and illustrated to explain the nature of the invention, may be made by those skilled in the art within the principle and scope of the invention. It is therefore understood that within the scope of the appended claims, the invention may be practiced otherwise than as specifically described.

What is claimed is:

1. A fendering apparatus employable for protection of watercraft and structures, said apparatus comprising:

a cylindrical body;

a buoyant collar body circumferentially enclosing a portion of said cylindrical body with said collar body positioned parallel to said cylindrical body such that a longitudinal axis of said collar body is collinear with a longitudinal axis of said cylindrical body and with said collar body mechanically attachable to said cylindrical body, said collar body mounted for axial movement and rotation with respect to a full length of said cylindrical body wherein the movement and rotation maintains said cylindrical body in a generally vertical orientation;

a flexible reservoir attached at a first end to a first end of said cylindrical body with said reservoir having an expandable and contractible wall with a second end; and a one-way valve positioned as an aperture within said second end of said reservoir through which said reservoir is operatively fillable with fluid to deploy said fendering apparatus to an extendable length as a protection to the watercraft and structures.

2. The apparatus of claim 1 wherein said apparatus further comprises at least one ballast weight positioned exterior to and flexibly connected to the second end of said reservoir and outside the periphery of said aperture wherein said at least one ballast weight is capable of assisting expansion of said reservoir and assisting in the operative action of said one-way valve when said apparatus is in a generally vertical position.

3. The apparatus of claim 2 wherein said reservoir further comprises a vent.

4. The apparatus of claim 3 said apparatus further comprising a first rope mechanically connected to said one-way valve such that when said first rope is in tension said one-way valve is capable of an open position to drain said reservoir.

5. The apparatus of claim 4 further compromising webbing straps surrounding an exterior of said cylindrical body with said webbing straps positioned to provide structural support to said cylindrical body.

6. The apparatus of claim 5 wherein the arrangement of said webbing straps includes a circumferential webbing strap that is circumferential to said cylindrical body;

wherein said apparatus further comprises a ring mechanically attached to said circumferential webbing strap and exterior to said cylindrical body; and a second rope affixed to said ring and said collar body such that said second rope is capable of limiting movement of said collar body.

7. The apparatus of claim 6 wherein said cylindrical body further comprises a bladder which is interior to said cylindrical body with said bladder capable of inflation and deflation thereby allowing expansion and compression of said cylindrical body.

8. The apparatus of claim 7 wherein said cylindrical body comprises an internal cable support in which said internal cable support connects the first end of said cylindrical body to a second end of said cylindrical body.

9. The apparatus of claim 8 wherein said at least one webbing strap is positioned to contain said bladder.

10. The apparatus of claim 9 wherein said collar body further comprises a trapezoidal cross-section arrangement as an outer surface of said collar body.

11. The apparatus of claim 10 wherein said collar body further comprises a hollow interior and an inflation and deflation valve wherein said collar body is capable of inflation and deflation.

12. The apparatus of claim 1 wherein said reservoir further comprises a vent.

13. The apparatus of claim 12 further comprising a first rope mechanically connected to said one-way valve such that when said first rope is in tension said one-way valve is capable of an open position to drain said reservoir.

14. The apparatus of claim 13 further compromising webbing straps surrounding an exterior of said cylindrical body with said webbing straps positioned to provide structural support to said cylindrical body.

15. The apparatus of claim 14 wherein the arrangement of said webbing straps includes a circumferential webbing strap that is circumferential to said cylindrical body;

wherein said apparatus further comprises a ring mechanically attached to said circumferential webbing strap and exterior to said cylindrical body; and a second rope affixed to said ring and said collar body such that said second rope is capable of limiting movement of said collar body.

16. The apparatus of claim 15 wherein said cylindrical body further comprises a bladder which is interior to said cylindrical body with said bladder capable of inflation and deflation thereby allowing expansion and compression of said cylindrical body.

17. The apparatus of claim 16 wherein said cylindrical body comprises an internal cable support in which said internal cable support connects the first end of said cylindrical body to a second end of said cylindrical body.

18. The apparatus of claim 17 wherein said at least one webbing strap is positioned to contain said bladder.

19. The apparatus of claim 18 wherein said collar body further comprises a trapezoidal cross-section arrangement as an outer surface of said collar body.

20. The apparatus of claim 19 wherein said collar body further comprises a hollow interior and an inflation and deflation valve wherein said collar body is capable of inflation and deflation.

* * * * *